US006247494B1

(12) United States Patent
Deininger

(10) Patent No.: US 6,247,494 B1
(45) Date of Patent: Jun. 19, 2001

(54) CONTROL VALVE DEVICE FOR A HYDRAULIC USER

(75) Inventor: Horst Deininger, Alzenau (DE)

(73) Assignee: Linde Aktiengesellschaft (DE)

( * ) Notice: Subject to any disclaimer, the term of this patent is extended or adjusted under 35 U.S.C. 154(b) by 0 days.

(21) Appl. No.: 09/517,822

(22) Filed: Mar. 2, 2000

(30) Foreign Application Priority Data

Mar. 5, 1999 (DE) ..... 199 09 712

(51) Int. Cl.[7] ..... F15B 13/044
(52) U.S. Cl. ..... 137/596.17; 137/596.2
(58) Field of Search ..... 137/596.17, 596.2

(56) References Cited

U.S. PATENT DOCUMENTS 5,738,142 * 4/1998 Eike et al. ..... 137/596.17

* cited by examiner

*Primary Examiner*—Gerald A. Michalsky

(74) *Attorney, Agent, or Firm*—Webb Ziesenheim Logsdon Orkin & Hanson, P.C.

(57) ABSTRACT

A control valve device for a hydraulic user includes an electrically actuated control valve that has a sliding spool for the control of the connection of at least one user channel that is in communication with the user with a delivery channel and a reservoir channel. A shutoff valve located in the user channel blocks a return flow from the user to the control valve. A pilot control valve actuates the shutoff valve. When the user channel is connected with the reservoir channel, the pilot control valve can be actuated to move the shutoff valve into the open position by an actuator element. The control valve device has a low actuation force for the deflection of the sliding spool and for the actuation of the pilot control valve. A gear train actuates the sliding spool and the actuator element. The gear train has an input element which is effectively connected with an electrical drive device and the output element which is in a driving connection with the sliding spool and is effectively connected with the actuator element. In one configuration, the output element is in connection by a connecting rod with the sliding spool and located on the output element is a cam disc which is connected by a rocker arm with the actuator element.

26 Claims, 7 Drawing Sheets

CONTROL VALVE DEVICE FOR A HYDRAULIC USER

BACKGROUND INFORMATION

1. Field of the Invention

This invention relates to a control valve device for a hydraulic user. More specifically, the invention relates to an electrically actuated control valve that has a sliding spool to control the connection of at least one user channel with a delivery and a reservoir channel, a shutoff valve in the user channel, which shuts off a return flow from the user to the control valve and a pilot valve to actuate the shutoff valve.

2. Background Information

Control valve devices are often used to actuate single-action or double-action users. On each of the user channels that lead from the sliding spool to the user, these devices have a shutoff valve that can be controlled by a pilot control valve for the leak-free isolation of the user. The shutoff valves are check valves that open toward the user and are generally spring-loaded and can be moved by the pilot valve into the open position to make possible a return flow from the user to the sliding spool if, as a result of a corresponding deflection of the sliding spool, the user channel is in communication with the reservoir channel. In this case, the pilot valves are also spring-loaded check valves and can be actuated by an actuator element, e.g., an actuator pin, to move them into the open position. In the open position, a connection is created between the control pressure compartment of the shutoff valve, which is in communication with the user and the reservoir channel so that the shutoff valve is moved into the open position by the pressure of the user. This makes possible a flow of hydraulic fluid from the user via the open shutoff valve and the sliding spool to the reservoir.

DE-OS 20 32 107 describes a similar control valve device of the prior art with a mechanically actuated control valve that is a sliding spool. In this device, the pilot control valves can be actuated by actuator pins moved into the open position. The actuator pins are in communication with diagonal, conical-shaped control surfaces formed on the sliding spool. When there is an axial deflection of the sliding spool, the pilot control valve can thus be opened by the actuator pin. With a mechanical actuation of the pilot control valves by a diagonal control surface formed on the sliding spool, a transverse force is exerted on the actuator pin, which in turn produces friction. As a result, the control valve device of this type is sluggish and subject to wear caused by friction. Consequently, with a control valve device of this type, a high actuation force is required to move the sliding spool and to actuate the pilot control valve.

The object of this invention is to make available a control valve device of the type described above with an electrically actuated control valve, which has a low actuation force to move the sliding spool and to actuate the pilot control valve.

SUMMARY OF THE INVENTION

The invention actuates the sliding spool and the actuator element through a gear train, the input element of which is effectively connected with an electrical drive apparatus. The output element of the gear train is in a driving connection with the sliding spool, and is effectively connected with the actuator element of the pilot control valve.

The invention provides a single-stage gear train that includes the input element and the output element. The input element is connected with the electrical drive device. The output element is provided for the actuation of the sliding spool and of the actuator element of the pilot control valve. The actuation of the sliding spool and of the actuator element is accomplished by the output element of the gear train.

The control valve device of the invention has the following series of advantages.

With a gear train of the invention, it becomes possible to easily move the actuator element so that any transverse forces, and thus friction on the actuator element, are eliminated. The result is a low actuation force of the control valve device to move the sliding spool and the actuator element.

Furthermore, as a result of reduced friction, there is a higher resistance to wear. As a result of an appropriate design of the gear train, a speed reduction can be achieved. Consequently, a low drive force or a low drive torque on the drive device is sufficient to achieve the necessary actuation force. An electric motor may be used as the electrical drive device. As a result of the elimination of control surfaces on the sliding spool for the actuation of the actuator element, the construction of the sliding spool can be made simpler, more compact and more economical to manufacture.

In one embodiment of the invention, the output element is effectively connected with a cam disc to actuate the actuator element. With a cam disc, while the output element is rotating, the actuator element can be deflected with a low actuation force, and the pilot control valve can thus be moved into the open position.

The cam disc may be connected with a rocker arm which is effectively connected with the actuator element. When the output element is in rotation, the rocker arm is thus rotated and deflects the actuator element. It is thereby possible to reduce the opening stroke of the pilot control valve that results from the movement of the actuator element to the angle of rotation of the output element. This increases the precision of the resolution. In addition, with an actuation of the actuator of this type by a rocker arm, an actuation of the actuator pin that does not involve any transverse forces becomes possible. As a result, a low actuation force is necessary for the actuation of the pilot control valve.

A further reduction of the actuation force for the pilot control valve can be achieved if the rocker arm is provided with a roller that is arranged to rotate and is in contact against the cam disc. The connection between the cam disc and the rocker arm is therefore almost frictionless.

In one configuration, in which the actuator element is an actuator pin, there are advantages if the actuator pin is a sphere on the end opposite the pilot control valve, and is mounted in a conical-shaped recess of the rocker arm. It is thereby possible to deflect the actuator pin easily and without any transverse forces, whereby wear on the actuator pin caused by transverse forces is also eliminated.

The cam disc can thereby be non-rotationally connected with the output element. In order to keep the number of components low, the cam disc may be integrally connected with the output element. To actuate the sliding spool and to actuate the pilot control valve, all that is necessary is an output element which is in a driving connection with the sliding spool and is connected with the actuator element via the rocker arm.

In one embodiment of the invention, the output element is effectively connected with the sliding spool by a connecting rod. The output element, together with the connecting rod and the sliding spool, forms a crank mechanism. With a connecting rod, it is easily possible to convert a rotational movement of the output element into a linear movement of the sliding spool. A connecting rod of this type requires only small angular deviations from the longitudinal axis of the sliding spool to achieve the piston stroke of the longitudinal shutter. Only low transverse forces occur on the sliding spool, and thus a low actuation force is necessary for the deflection of the sliding spool.

In one refinement of the invention, the connecting rod is suspended in the sliding spool and/or in the output element. The installation of the connecting rod can thereby be performed simply by suspending the connecting rod in the sliding spool and/or the output element. Removing it is also simple. No additional fastening parts are required to connect the connecting rod with the output element and the sliding spool, which results in reduced manufacturing costs and easier assembly.

In one embodiment of the invention, to connect the connecting rod with the sliding spool and/or the output element, there is a sphere which can be fastened in a spherical-shaped recess. A sphere that can be housed in a spherical-shaped recess represents a simple design for the suspension of the connecting rod in the sliding spool or the output element.

This design can be achieved with little effort and manufacturing expense if the sphere is located on the connecting rod and the spherical-shaped recess is located on the output element and/or on the sliding spool. The sphere may be formed on the connecting rod and the spherical-shaped recess may be formed on the sliding spool. It is easily possible with little effort to manufacture a sphere on the connecting rod and a spherical-shaped recess on the sliding spool.

In an additional embodiment of the invention, to connect the connecting rod with the output element and/or the sliding spool, there is a boring in which a pin or bolt is rotationally fastened. This is likewise an easy and economical way to suspend the connecting rod in the sliding spool or in the output element without the need for additional fastening parts. The boring in the output element may be oriented parallel to the axis of rotation of the output element, and the connecting rod may be provided with the pin or bolt. A boring can easily be created in the output element. The connecting rod can also easily be provided with the pin or bolt, for example, by screwing or pressing. The bolt or pin can also be integral with the connecting rod. A connection of this type between the connecting rod and the output element is also extremely compact.

A fastening fork may be on the output element through a recess that is in communication with the boring. For this purpose, the connecting rod can be located in the fastening fork formed by the recess, and can thus be secured in the output element in the axial direction with respect to the boring.

In the outer area of a lateral bracket of the fastening fork, there may be an opening that runs through the lateral bracket. The presence of the opening in a lateral bracket of the output element makes it possible to move the connecting rod in the axial direction in the boring for installation or removal until the connecting rod is located in the fastening fork formed by the recess. As a result of the presence of the opening in the outer portion of the lateral bracket, the connecting rod can also be suspended in the output element and/or removed from the output element at angles of rotation of the output element that are beyond the range of angles of rotation that occur during operation of the control valve device. With an arrangement of this type, it therefore becomes possible that at angles of rotation of the output element that occur during operation, the connecting rod can be secured between the lateral brackets of the fastening fork against accidentally becoming unhinged in the recess of the output element.

The gear train may be a worm gear pair. In one embodiment of the invention, the gear train is a spur gear. A spur gear is easy to manufacture, which results in low manufacturing costs. The spur gear can be made particularly compact if the output element is a toothed quadrant that is engaged with an input element in the form of a gear wheel. As a result of the crank mechanism that includes the output element, the connecting rod and the sliding spool, all that is necessary to generate the piston stroke is a limited angle of rotation of the output element of the spur gear of the sliding spool. As a result, the output element can be a toothed quadrant of a gear wheel.

The input element can be non-rotationally connected with an output shaft of the drive device. The input element may be integral with the output shaft of the drive device. The input element, which can be a gear wheel, for example, can thereby be formed on the output shaft of the drive device.

The cost of manufacture of the control valve device of the invention can be reduced if the gear train is located in a transmission housing to which the drive device can be fastened. The transmission housing can thereby be fastened to a control valve block of the control valve device. The input element and the output element as well as the drive device are thus located in or on a separate transmission housing which is connected with the control valve block. Thus no additional devices are necessary in the control valve block for the mounting of the input or output element or for the fastening of the drive device. As a result, the control valve block is economical to manufacture.

The cost of manufacturing can be further reduced if the rocker arm and the pilot control valve are located in the transmission housing, and the actuator pin is mounted in the transmission housing so that it can move longitudinally. The actuator devices for the sliding spool and the shutoff valve are thereby located in the transmission housing, which is connected with the sliding spool only by the connecting rod. This results in easy installation and removal of the actuator device on the valve block because all that is necessary is to suspend or remove the connecting rod in the sliding spool or the output element. As a result of the integration of the pilot control valve into the transmission housing, less effort is also required to manufacture a control valve block in a multi-layer construction. The multi-layer construction includes a plurality of segment plates that are connected to one another by soldering or by some other adhesive. Complex, time-consuming and expensive borings at a right angle to the layers can be eliminated, as a result of which the cost of manufacturing a multi-layer control valve block can be reduced.

With regard to a low cost of manufacture for the transmission housing, the transmission housing may have an opening in an area that faces the control valve block, and the output shaft of the drive device may be rotationally mounted in a housing boring of the transmission housing. The diameter of the input element that is effectively connected with the output shaft is less than or equal to the diameter of the housing boring. The output element and the rocker arm can thereby be installed through the opening in the transmission housing. When the transmission housing is attached to the control valve block, the connecting rod that is effectively connected with the sliding spool can also be guided through the opening. The diameter of the input element is less than or equal to the diameter of the output shaft. The output shaft of the drive device and the input element that is effectively connected with the drive device can thereby be inserted through the housing boring into the transmission housing. An additional housing cover on the transmission housing is not necessary for the installation of the input element.

In the vicinity of the housing boring, there may be a sealing device to seal the output shaft with respect to the transmission housing. It thereby becomes possible in a simple manner to seal the drive device with respect to the transmission housing.

In one refinement of the invention, the sliding spool is effectively connected with a spring retraction device. A spring retraction device, which moves the sliding spool to the center position when it is not actuated, also eliminates the gear play between the input element and the output element when the sliding spool is not in the center position, i.e., when the control valve device is actuated.

The electrical drive device may be a drive motor, in particular a stepper motor. In the control valve device of the invention, the speed reduction necessary for the actuation of the sliding spool is achieved by the gear train when a stepper motor is used, combined with the actuation of the pilot control valve without transverse force and thus without wear to the actuator pin, whereby the rocker arm also reduces the opening stroke of the pilot control valve to the piston stroke of the sliding spool and thus achieves an improved resolution.

BRIEF DESCRIPTION OF THE DRAWINGS

Additional advantages and details of the invention are explained in greater detail below with reference to the exemplary embodiments that are illustrated schematically in the accompanying figures, in which.

DESCRIPTION OF THE PREFERRED EMBODIMENTS

Figure 1:
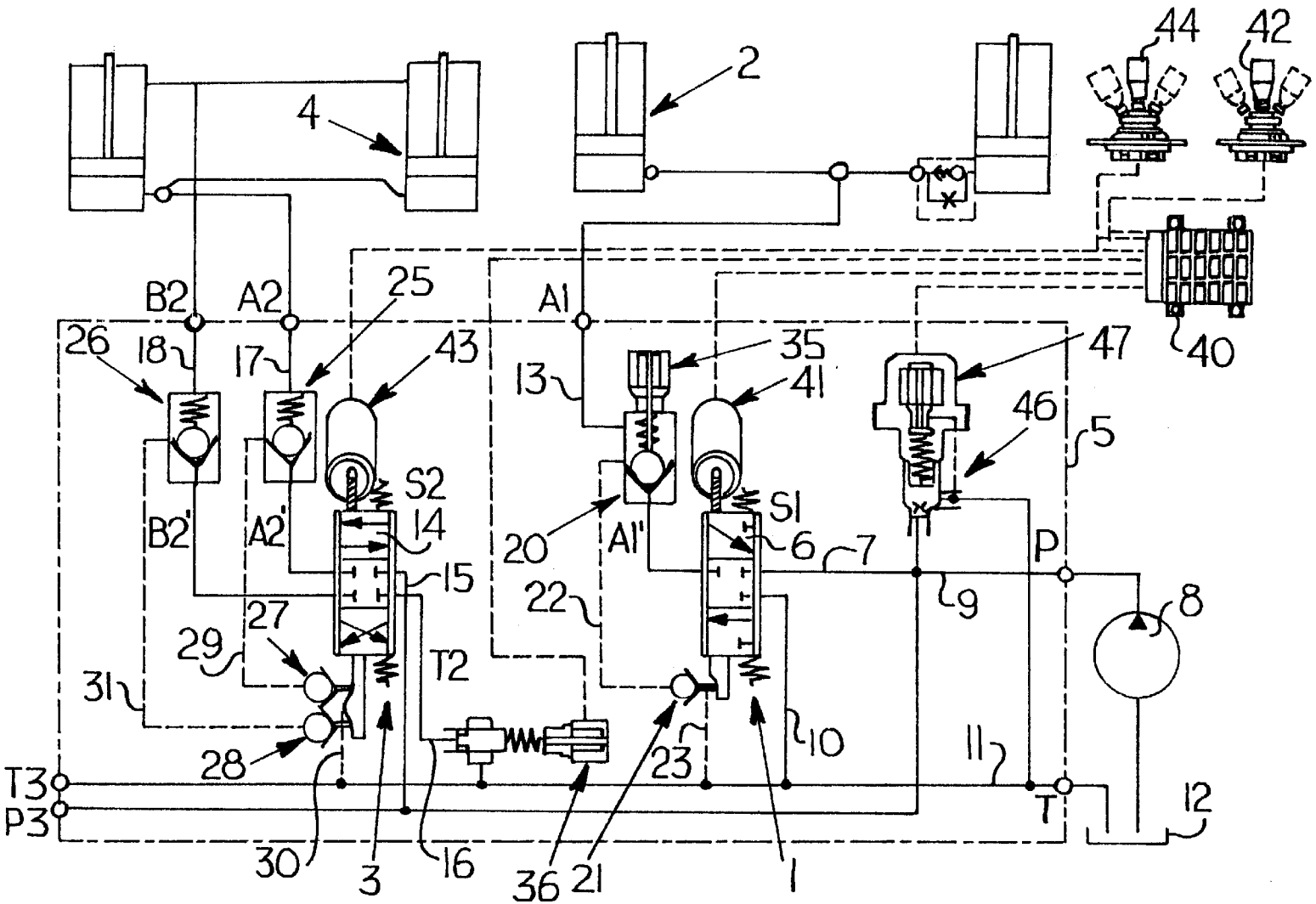
FIG. 1 is a schematic diagram of a control valve device according to the invention.

FIG. 1 is a schematic diagram of a hydrostatic drive system with a first exemplary embodiment of a control valve device 1 of the invention for the control of a single-action user 2, for example a single-action hydraulic cylinder, and a second exemplary embodiment of a control valve device 3 of the invention for the control of a double-action user 4, for example a double-action hydraulic cylinder. The user 2 may be, for example, a lifting cylinder and the user 4 may be a tilting cylinder of an industrial truck. The control valve devices 1, 3 are located in a common control valve block 5.

The control valve device 1 has a control valve 6 which is connected on the input side to a delivery branch channel 7, which is in communication with a delivery 10 channel 9 connected to a pump 8. A reservoir branch channel 10 leads from the control valve 6 to a reservoir channel 11, which leads to a reservoir 12. The connection between the delivery branch channel 7 or the reservoir branch channel 10 and a user channel 13, which is connected 15 with the user 2, can be controlled with the control valve 6.

The control valve device 3 has a control valve 14 which is connected by a delivery branch channel 15 to the delivery channel 9 and by a reservoir branch channel 16 to the reservoir channel 11. Two user channels 17, 18 lead to the user 4, and the connection between these user channels 17, 18 and the delivery branch channel 15 or the reservoir branch channel 16 can be controlled by the control valve 14.

The control valves 6 and 14 are sliding spool valves with a spring-centered center position that provide throttling in intermediate positions. In the center position of control valves 6 and 14, the corresponding connections are closed.

For the leak-free isolation of the user 2, a shutoff valve 20, in the form of a check valve that opens toward the user 2, is located in the user channel 13. When the control valve 6 is actuated into the switched position illustrated in the top of FIG. 1 to lower a load applied to the user 2, the shutoff valve 20 can be moved toward an open position by a pilot control valve 21 that is also in the form of a check valve. The control pressure chamber of the shutoff valve 20 that acts in the closing direction is thereby connected by a control pressure line 22 to the control pressure chamber of the pilot control valve 21 that acts in the closing direction, and is in communication by a control pressure line 23 with the reservoir channel 11.

For the leak-free isolation of the user 4, shutoff valves 25, 26 that open toward the user 4 are located in the user channels 17, 18, respectively. Each of the shutoff valves 25, 26 can be actuated by a pilot control valve 27, 28 that is in the form of a check valve. For this purpose, a control pressure line 29 runs from the control pressure chamber of the shutoff valve 25 that acts in the closing direction to the pilot control valve 27. The pilot control valve 27, through a control pressure line 30, makes possible a connection between the control pressure line 30 and the reservoir channel 11 in the opened position. The control pressure chamber of the shutoff valve 26 that acts in the closing direction is connected by a control pressure line 31 to the pilot control valve 28, which in the open position makes possible a connection between the control pressure line 31, via the control pressure line 30, and the reservoir channel 11. The pilot control valve 27 can thereby be actuated in the event of an actuation of the control valve 14 toward the bottom switched position illustrated in the figure and the pilot control valve 28 can be moved, in the event of an actuation of the control valve 14 toward the top switched position in the figure. The shutoff valves 25 and 26, which in the corresponding switched position of the control valve 14 are located in the user channels 17, 18 which is in communication with the reservoir branch channel 15 and thus in the return line of the user 4, are actuated into the open position, as a result of which hydraulic fluid can flow from the user channel 17 or 18 to the reservoir 12.

To determine the speed of movement of the user 2, there is a sensor device 35 that is a delivery flow sensor, which is connected with an electronic control device 40. The measurement element of the sensor device 35 can thereby be the valve body of the shutoff valve 20. The sensor device 35 can also be formed so that the corresponding speed of movement of the user 2 can be measured both during the ascent and the descent of the user 2.

The speed of movement of the user 4 can be measured by a sensor device 36, which is effectively connected with the electronic control device 40. The sensor device 36 can be a delivery flow sensor, for example, which is located in the reservoir branch line 16 that is in communication with the reservoir 12.

The control valve 6 can be actuated electrically, whereby there is an electrical drive device 41, such as a stepper motor, for example, which is connected to the electronic control device 40. The direction of movement and a setpoint speed are specified by a setpoint device 42, such as a joystick, for example, which is effectively connected with the electronic control device 40. The control valve 14 can also be actuated electrically, for example by a drive device 43 that is a stepper motor, and is effectively connected with an electronic control device 40. To specify a direction of movement and a setpoint speed of the user 4, there is a setpoint device 44, such as a joystick, for example, which is connected with the electronic control device 40.

To control the unpressurized circulation of the delivery flow of the pump 8, which is a constant delivery pump, when the control valves 6, 14 are not actuated, and to limit the maximum working pressure of the users 2, 4, there is a pilot-controlled pressure relief valve 46 which is connected on the input side to the delivery channel 9 and on the output side to the reservoir channel 11. The response pressure of the pressure relief valve 46 is thereby set by an electrically actuated pilot control valve 47 which is connected to the electronic control device 40.

Figure 2:
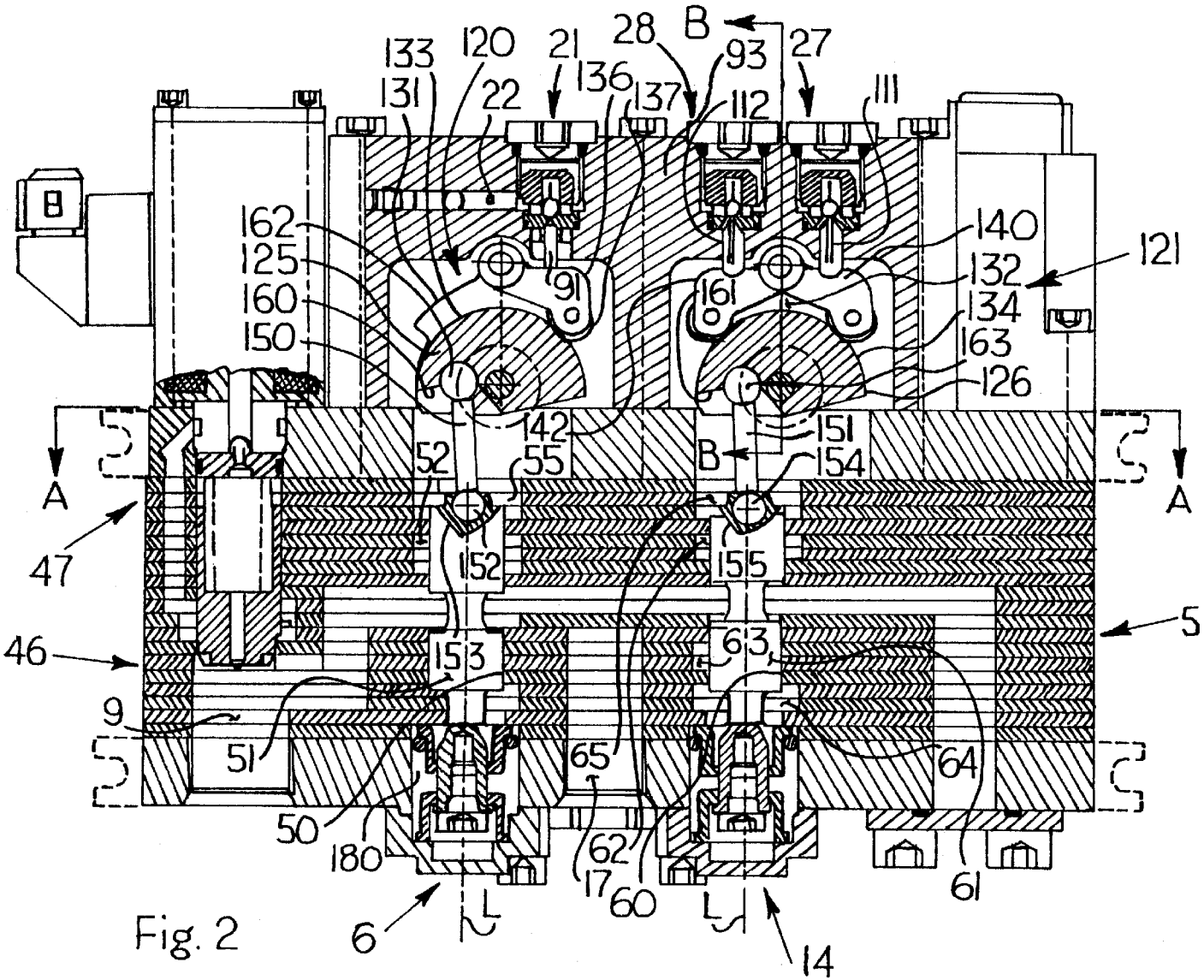
FIG. 2 is a longitudinal sectional view through a control valve device as illustrated in FIG. 1.
Figure 3:
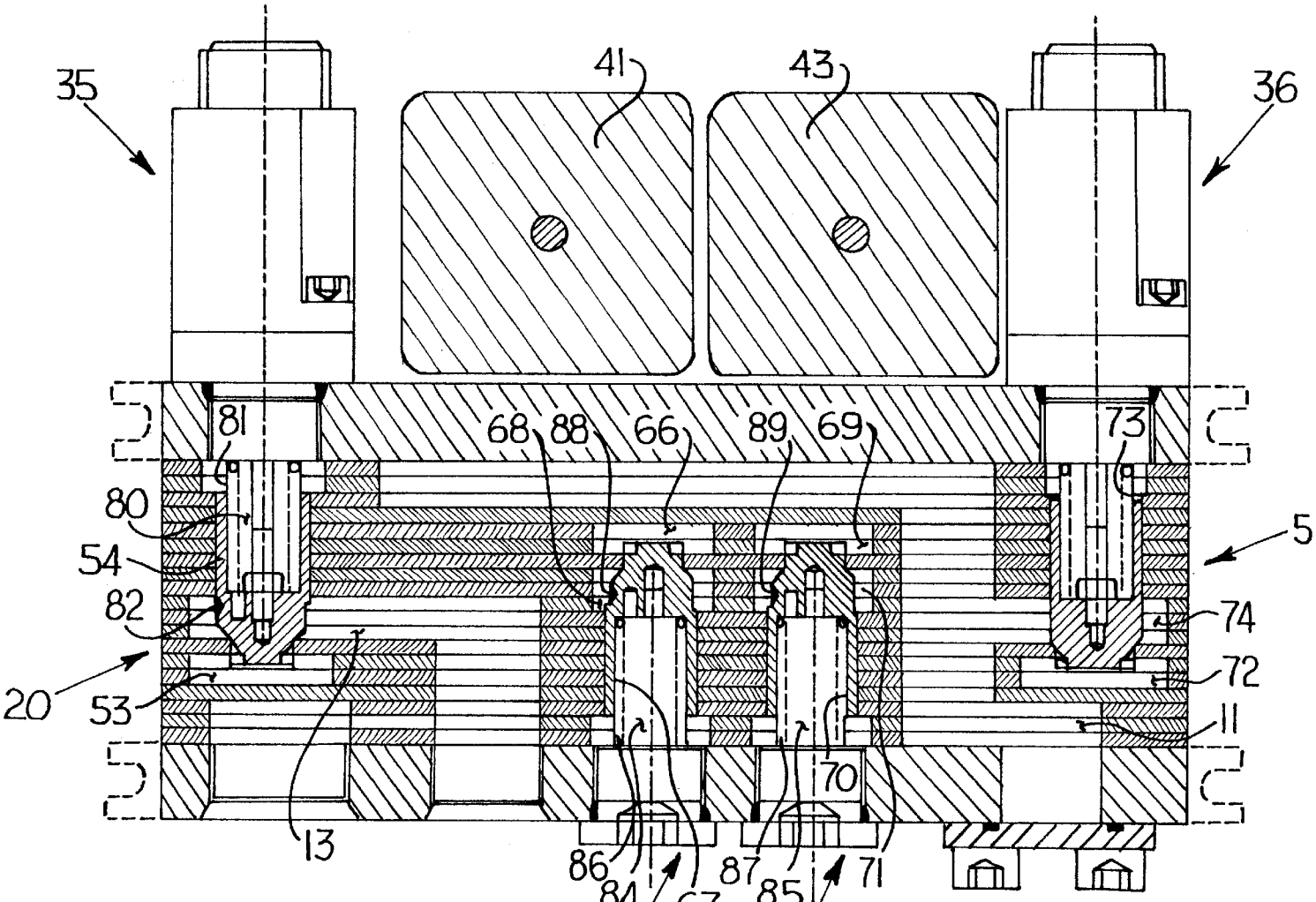
FIG. 3 is an additional longitudinal sectional view through the control valve device as illustrated in FIG. 1.

FIGS. 2 and 3 each show a longitudinal section through the control valve block 5 which has a construction that consists of a plurality of segment plates that are connected together by soldering or some other adhesive process. The delivery channel 9 and the reservoir channel 1 are formed by communicating recesses in some of the segment plates.

The sliding spool 51 or the control valve 6 is located so that it can move longitudinally in a housing boring 50 that is formed in the control valve block 5. The housing boring 50 is thereby provided with an annular groove 52 that starts from an annular groove that is connected with the delivery channel S. The annular groove 52 is connected to the user channel 13. The annular groove 52 is in communication with an annular groove 53 of a housing boring 54 in which the shutoff valve 20 is located, which simultaneously forms the sensor device. An additional annular groove 55 that is on the housing boring 51 is in communication with the reservoir channel 11.

In a housing boring 60 of the control valve block 5, the sliding spool 61 of the control valve 14 is located so that it can move longitudinally, whereby the housing boring 60, starting from an annular groove that is in communication with the delivery channel 9, is provided with a plurality of annular grooves 62, 63, 64 and 65. The annular groove 62 is in communication with an annular groove 66 on a housing boring 67, in which the shutoff valve 25 is located. The housing boring 67 is in turn in communication with an annular groove 68 which is in communication with the user channel 17 in a manner not illustrated in any further detail. In an analogous manner, the annular groove 63 is in communication with an annular groove 69 of a housing boring 70, in which the shutoff valve 26 is located. An annular groove 71 on the housing boring 70 is thereby in communication with the user channel 18 in a manner not illustrated in any further detail. The annular groove 64 and the annular groove 65 of the housing boring 60 lead to an annular groove 72 on a housing boring 73, in which the sensor device 36 is located. An annular groove 74 located on the housing boring 73 is thereby in communication with the reservoir channel 11.

The shutoff valve 20 has a control pressure chamber 80 that acts in the closing direction. A spring 81 is located in control pressure chamber 80 which is in communication via a throttle device 82 with the segment of the user channel 13 that is connected to the user 2. In an analogous manner, the shutoff valves 25 and 26 each have a control pressure chamber 84 or 85 which acts in the closing direction, in which there are respective springs 86 and 87, and which are in communication via respective throttle devices 88 and 89 with the annular grooves 68 and 71. Control pressure chambers 84 and 85 are in communication with the corresponding segment of the user channels 17 and 18 which are in communication with the user 4.

The control pressure chamber 80 of the shutoff valve 20 is in communication, in a manner not shown in any greater detail, with the control pressure line 22 which leads to the pilot control valve 21. The control pressure chambers 84 and 85 of the shutoff valves 25 and 26, respectively, are connected to the control pressure lines 29 and 31, respectively, which are not shown in any greater detail and which lead to the respective pilot control valves 27 and 28. The shutoff valves 20, 25 and 26 thereby have a differential piston surface.

Figure 7:
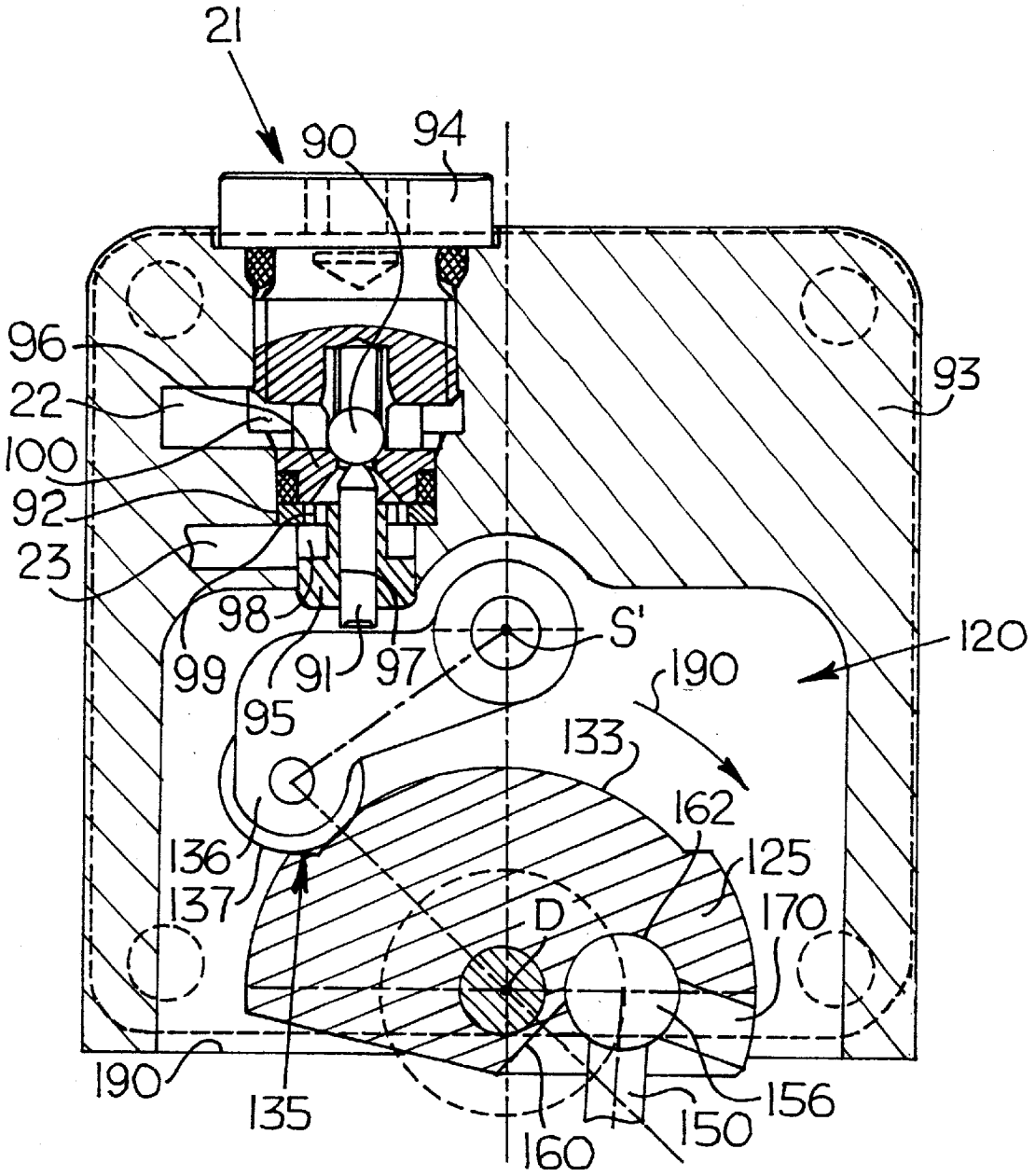
FIG. 7 is a sectional view taken along Line D—D in FIG. 4.

As shown in FIGS. 2 and 7, the pilot control valve 21 is a spring-loaded check valve in the isolation position with a valve element 90 that is in the form of a sphere. The valve element can be moved toward an opening position by an actuator element 91 that is in the form of an actuator pin. The pilot control valve 21 is thereby located in a step-shaped boring 92 of a transmission housing 93 which is closed by a screw plug 94. The pilot control valve 21 consists of a component 95 in connection with a flange on a shoulder of the boring 92, and a valve seat component 96 in contact with the component 95 and provided with a longitudinal opening 97 which, on the end opposite the component 95, forms a valve seat for the valve element 90. The actuator pin 91 is mounted so that it can move longitudinally in a boring of the component 95. In the component 95, there is an annular groove 98 in communication via opening 99 with the longitudinal opening 97 of the component 96. The annular groove 98 is thereby in communication with the control pressure line 23, which can lead to the reservoir channel, for example. A control pressure chamber 100 in the boring 92, and which is active in the closing direction of the valve element 90, is in communication with the control pressure line 22.

Figure 8:
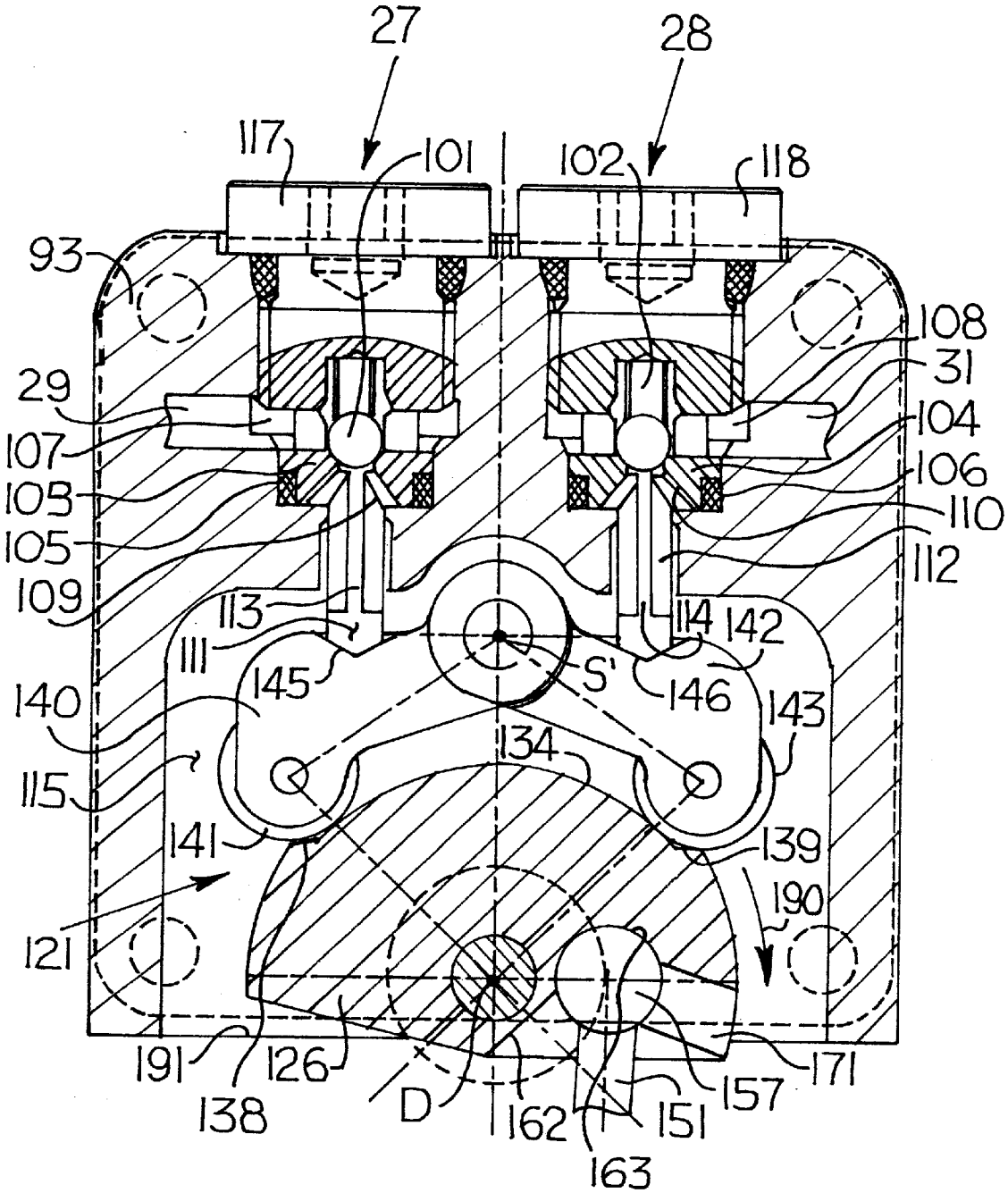
FIG. 8 is a sectional view taken along Line E—E in FIG. 4.

FIG. 2 and FIG. 8 show the construction of the pilot control valves 27, 28, which are spring-loaded check valves with valve elements 101, 102 in the form of a sphere. The valve seat of the valve element 101, 102 is realized in respective valve seat component 103, 104, located in a step-shaped boring 105, 106 of the transmission housing 93. The boring 105, 106 can be closed by a respective screw plug 117 or 118. In the borings 105, 106 there are respective control pressure chambers 107 and 108 which are active in the direction of the closing position. The control pressure chamber 107 is connected to the control pressure line 29 and the control pressure chamber 108 is connected to the control pressure line 31. The valve seat components 103 and 104 are each provided with respective longitudinal openings 109 and 110. Actuator elements 111 and 112 that are in the form of actuator pins that can move respectively in the borings 105 and 106 are each provided with a longitudinal groove. When the valve elements 101, 102 are open, hydraulic fluid can flow out of the control pressure lines 29, 31 via the longitudinal grooves 113, 114 into the interior of the housing 115. As shown in FIG. 2, housing 115 is in communication with the annular groove 65 which can be brought into communication with the reservoir channel 11. The boring 105, 106 is thereby widened in the vicinity of the actuator element 111, 112, so that the actuator pin 111, 112 is mounted in the boring 105, 106 only in the area facing the valve seat element 101, 102.

Figures 5, 6:
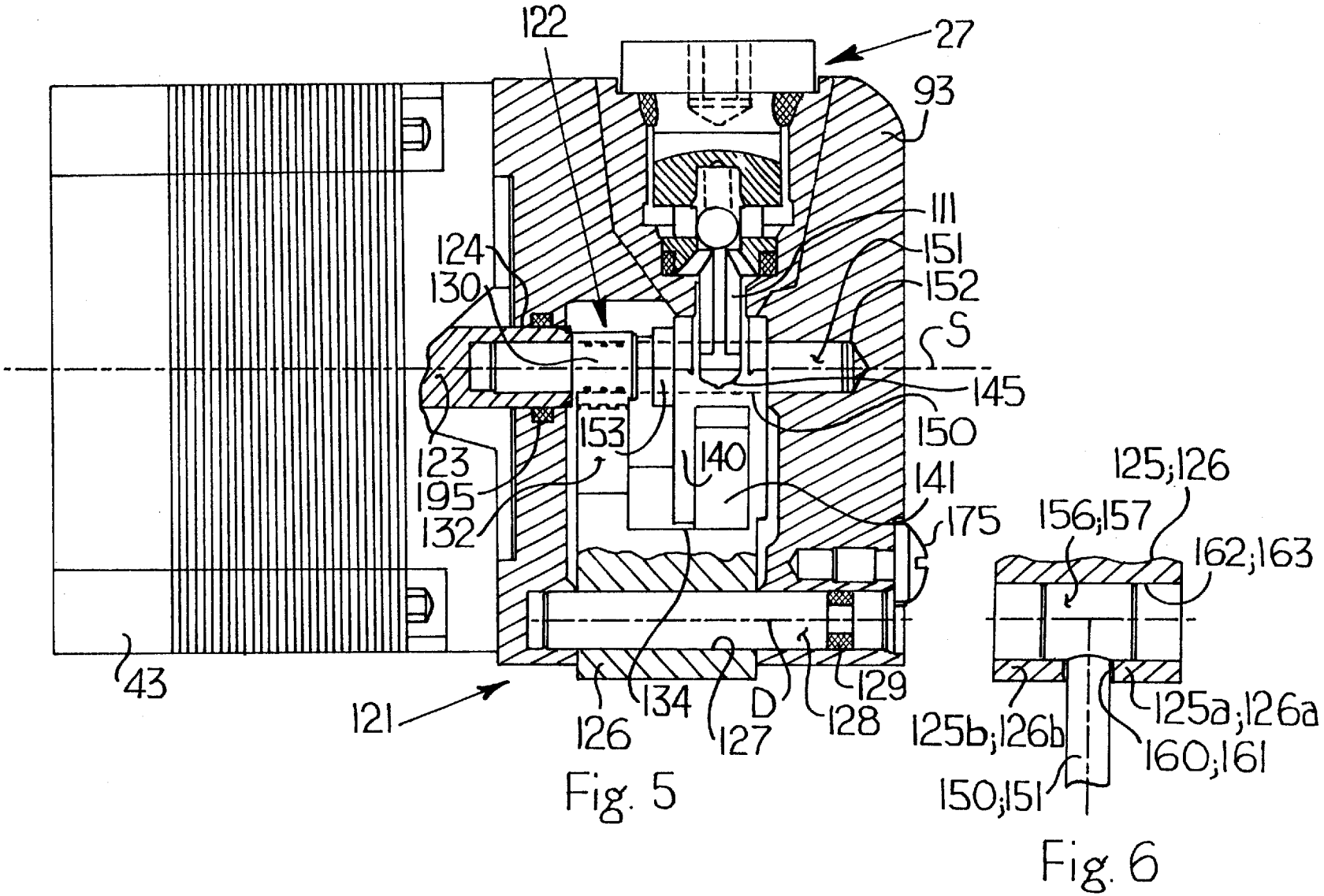
FIG. 5 is a sectional view taken along Line B—B in FIG. 2.
FIG. 6 is a sectional view taken along Line C—C in FIG. 4.

To actuate the sliding spool 61 or 62 and the pilot control valve 21 or 27, 28 associated with the sliding spools, there is a gear train 120 or 121 that is in the form of a spur gear. FIG. 5 shows a longitudinal section of gear train 121 by way of example for the gear trains 120, 121.

The input element 122 of the gear train 120 and 121 is non-rotationally connected with the output shaft 123 of the corresponding electrical drive device 41 or 43, which can be a stepper motor, for example. The drive device 41 or 43 is thereby detachably fastened to the transmission housing 93 by screws. The output shaft 123 of the drive device 41 or 43 is rotationally mounted in a housing boring 124 of the transmission housing 93. In the vicinity of the housing boring 124 there is also a sealing device 195. The transmissions 120 or 121 have respective output elements 125 and 126 which are mounted so that they can rotate around an axis of rotation D that is oriented parallel to the output shaft 123 and perpendicular to the longitudinal axis L of the sliding spools 51 and 61, respectively. For purposes of mounting, the output elements 125 and 126 are provided with a boring 127, which is penetrated by a bearing pin 128 that is located in the transmission housing 93. The bearing pin 128 is axially secured in the transmission housing 93 by a securing device 175 and is sealed by a sealing device 129.

The input element 122 of the transmission 120 and 121, respectively, is a gear wheel which is non-rotationally connected with the output shaft 123. The gear wheel is engaged with a gear wheel that is in the form of a toothed quadrant 131, 132. The toothed quadrants 131 and 132 are formed integrally, i.e. in one piece, on the respective output elements 125 and 126. The outside diameter of the input element 122 is thereby less than or equal to the diameter of the housing boring 124, whereby the output shaft 123 can be inserted together with the input element 122 into the transmission housing 93. A cam disc 133 or 134 is also formed on or non-rotationally fastened to the respective output element 125 or 126. The cam disc 133, as shown in FIG. 7, also has an effective cam 135 which is effectively connected with a roller 137 that is rotationally located on a rocker arm 136. The cam 135 is effectively connected with a roller 137 that is rotationally connected to a rocker arm 136. In the illustrated center position of the control valve device 6, the roller 137 is thereby in contact with the cam 135. The cam disc 134, as shown in FIG. 8, has two effective cams 138, 139. The cam 138 is in contact with a roller 141 that is located on a rocker arm 140 and the cam 139 is in contact with a roller 143 that is located on a rocker arm 142, in the illustrated center position of the control valve 14.

The respective rocker arms 136 or 140, 142 are each rotationally mounted around a pivoting axis S in the transmission housing 93, which pivoting axis S is oriented parallel to the axis of rotation D of the respective output elements 125 and 126. The pivoting axis S is coaxial to the output shaft 123. For the rotational fastening of the rocker arm 136 or of the rocker arm 140, 142, the rocker arms are each provided with a boring 150 to hold a bearing pin 151 which is fastened in a boring 105 of the transmission housing 93 and secures the rocker arm or rocker arms in the axial direction by a collar 153.

The rocker arm 136 which is in effective contact with the cam 135 of the cam disc 133 that is formed on the output element 125 is connected with the actuator pin 91 of the pilot control valve 21. The actuator pin 91 is thereby in contact with the external surface of the rocker arm 136. The rocker arm 140 which is in effective contact with the cam 138 of the cam disc 134 that is formed on the output element 126 controls the pilot control valve 27 by the actuator pin 111. The rocker arm 142 that is in effective contact with the cam 139 of the cam disc 134 controls the pilot control valve 28 by the actuator pin 112. The actuator elements 111, 112 are thereby in a spherical shape in the portion that projects out of the borings 105, 106 of the transmission housing 93, and are located in conical-shaped recesses 145, 146 of the corresponding rocker arms 140, 142.

To actuate the sliding spool 51, there is a connecting rod 150 which is connected with the output element 125 of the transmission 120 and the sliding spool 51. The sliding spool 61 is actuated by a connecting rod 151 which is connected with the output element 126 of the transmission 121 and the sliding spool 61.

The connecting rod 150 or 151 is suspended for easy installation in the respective output element 125 or 126 and in the respective sliding spool 51 or 61. For this purpose, the end of the connecting rod 150 or 151 facing the sliding spool 51 or 61 is provided with a sphere 152 or 154, which is held by suspension in a spherical-shaped recess 153, 155 on the end surface of the sliding spool 51 or 61.

Figure 4:
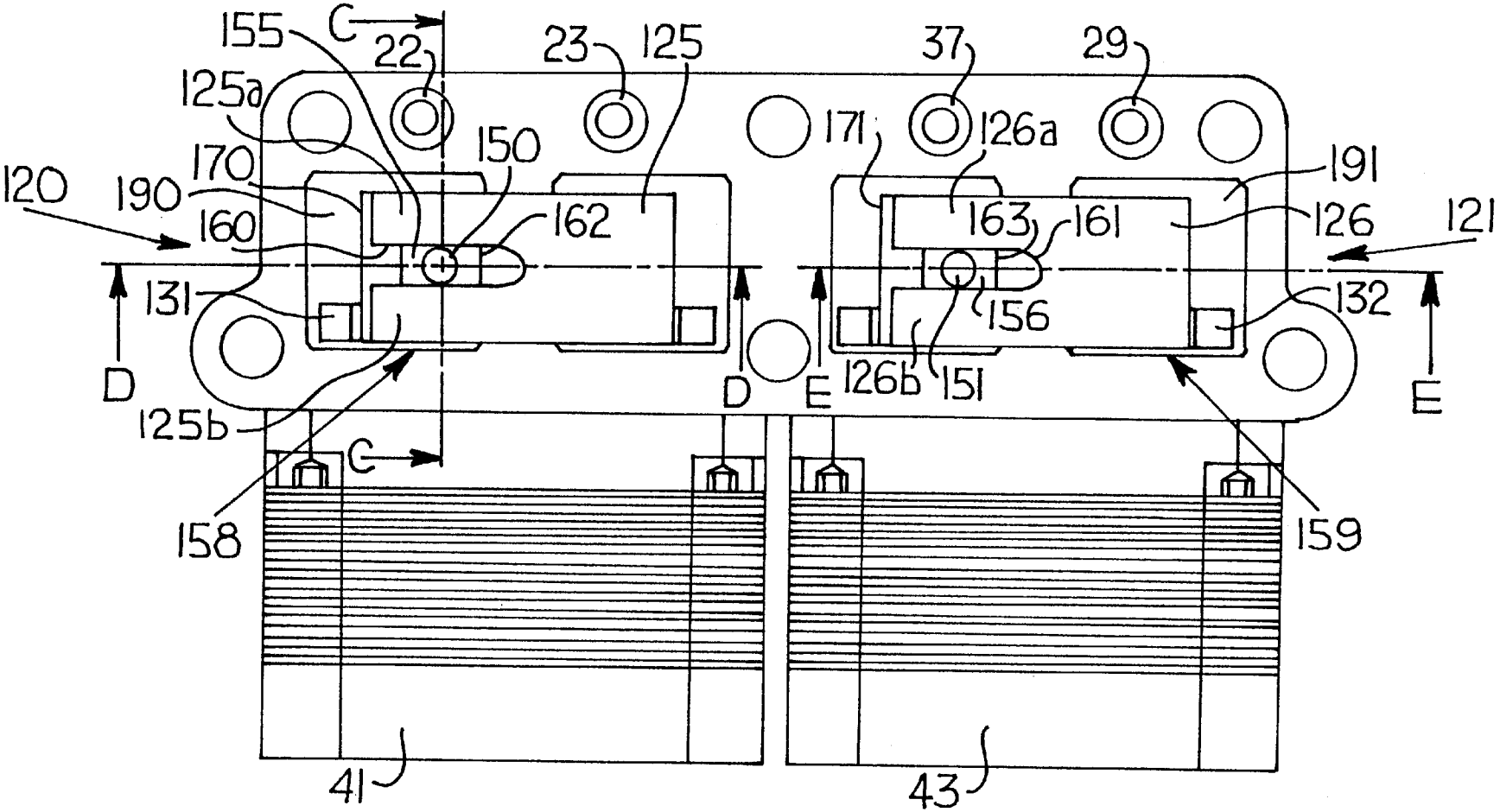
FIG. 4 is a sectional view taken along Line A—A in FIG. 2.

To fasten the connecting rod 150, 151 in the output element 125, 126, as shown in FIGS. 2, 4 and 6 to 8, in each output element 125, 126, a recess 160, 161 is in a center plane of the output element. The recesses 160, 161, as shown in FIG. 4, form, in the respective output elements 125, 126, fastening forks 158, 159, each of which has two lateral brackets 125*a*, 125*b*, and 126*a*, 126*b*. In the vicinity of the recess 160, 161 and thus of the fastening fork 158, 159, the output element 125, 126 is provided with a transverse boring 162, 163, which is oriented parallel to the axis of rotation D of the output element 125, 126. The connecting rod 150, 151 is provided on the end opposite the sphere 152, 153 with a pin 156, 157 which is oriented perpendicular to the shaft of the connecting rod 150, 151. The pin 156, 157 can, for example, be pressed or screwed to the connecting rod 150, 151.

The connecting rod 150, 151 is located in the recess 160, 161 and is secured in the axial direction between the side pieces 125*a*, 125*b* and 126*a*, 126*b* of the respective fastening fork 158, 159. A lateral bracket 125*a*, 126*a* of the respective fastening fork 158, 159 is penetrated by an opening 170, 171, located in the vicinity of a boundary surface of the recess 160, 161 and thus in the outer portion of the fastening fork 158, 159, and which extends from the transverse boring 162, 163 to the outer periphery of the output element 125, 126. If the connecting rod 150, 151 is pivoted far enough that it is aligned with the opening 170, 171, the connecting rod 150, 151 can be pushed in the axial direction out of or into the transverse boring 162, 163 and thus the recess 60, 161. The opening 170, 171 is thereby located so that the pivoting angle of the output element 125, 126 for the installation or removal of the connecting rod 150, 151 in the output element 125, 126 lies outside the angle of rotation that occurs during operation of the control valve 6, 14.

The sliding spool 51 or 61, as shown in FIG. 2, is effectively connected on the end opposite the connecting rod 150 or 151 with a spring retraction device 180 or 181 that acts in both directions. The spring retraction device 180 or 181 retracts the sliding spool 51 or 61 into the illustrated center position and eliminates gear play between the input element 122 and the output element 125 or 126 of the respective gear train 120, 121 outside the center position.

As shown in FIGS. 4, 7 and 8, the housing 93, in an area facing the control valve block 5, has an opening 190 or 191, through which the rocker arm 136 or 140, 142 and the output element 125 or 126 can be installed. In addition, when the transmission housing 93 is attached to the control valve block 5, the connecting rod 150 or 151 to the sliding spool 51 or 61 is guided through the opening 190 or 191.

The function of the control valve device is explained in greater detail by way of example below, with reference to the gear trains illustrated in FIGS. 7 and 8, in connection with FIGS. 2 and 3:

When the output element 125 of the gear train 120 is actuated by a determined angle of rotation in the direction 190 by a corresponding actuation of the input element of the gear train 120, as the result of an actuation of the drive device 41 by a larger angle of rotation in the opposite direction, the rocker arm 136 is deflected upward in FIG. 7 from the cam 135 formed on the cam track 133, as a result of which the rocker arm 136 is pivoted around the axis of rotation S upward in FIG. 7, and the valve element 90 of the pilot control valve 21 is pushed by the force of the actuator element 91 against the force of the spring into the opening position. As a result, hydraulic fluid flows from the control pressure line 22 via the control pressure chamber 100, the longitudinal opening 97, the opening 99 and the annular groove 98 into the control pressure line 23, which is connected with the reservoir channel 11. The control pressure chamber 80 of the shutoff valve 20 is thereby depressurized and the shutoff valve 20 is pushed into the opening position by the pressure in the user channel 13. At the same time, the connecting rod 150 is deflected downward in FIG. 7, so that the sliding spool 51 is deflected downward in FIG. 2, in which a connection is created between the annular groove 52 and the annular groove 55, which is in communication with the reservoir channel 11, as a result of which hydraulic fluid can flow from the user 2 via the opened shutoff valve 20 and the sliding spool 51 to the reservoir 12.

When the output element 126 of the gear train 121 is pivoted in the direction 190 by a corresponding deflection of the input element 112 by the drive device 43, the rocker arm 140 is deflected upward in the FIG. 8 by the cam 138 located on the cam disc 134 around the axis of rotation S, and thus the valve seat element 101 of the pilot control valve 27 is pushed into the open position by the actuator pin 111. The control pressure line 29 is thereby connected via the control pressure chamber 107, the longitudinal opening 109 and the longitudinal groove 113 of the actuator element 111 with the interior 115 of the housing, which is in communication with the annular groove 65. The control pressure chamber 84 of the shutoff valve 25 is thereby depressurized and the shutoff valve 25 is pushed into the opening position by the user pressure. The connecting rod 151 thereby deflects the sliding spool 61 downward in FIG. 2 into a position in which the annular groove 62 is in communication with the annular groove 65 and the annular groove 63 is in communication with the delivery channel 9, and thus the user channel 18 forms the admission line and the user channel 17 the return line of the user 4, whereby hydraulic fluid can flow out of the user via the opened shutoff valve 25.

When there is a deflection of the output element 126 in a direction opposite to the direction 190, the rocker arm 142 is correspondingly pivoted by the cam 139 and the pilot valve 28 is moved into the open position, as a result of which the shutoff valve 26 is actuated. In this switched position of the sliding spool 61, in which the annular groove 63 is in communication with the annular groove 64 and thus with the reservoir channel 11, and the annular groove 62 is in communication with the delivery channel 9 and thus with the user channel 17, represents the admission line and the user channel 18 the return line of the user 4, is located in the return line of the user 4 and thus makes possible a flow of hydraulic fluid from the user 4 to the reservoir 12.

With the gear train 120, 121 provided in the control valve device 6, 14 of the invention, there is a necessary reduction of the angle of rotation of the drive device when a stepper motor is used for the actuation of the sliding spool 51, 61. An actuation of the pilot control valves 21, 27, 28 by rotationally mounted rocker arms 136, 140, 142 which deflect the actuator elements 91, 111, 112, results in no transverse forces occurring on the actuator elements 91, 111, 112 which could lead to wear and increased actuation forces. In addition, as a result of the presence of the rocker arms 136, 140, 142, the opening stroke of the pilot control valves 21, 27, 28 is reduced to the piston stroke of the sliding spool 51, 61. As a result, it is ensured that the pilot control valves 21, 27, 28 can be moved into the open position even with a short piston stroke of the sliding spool 51, 61. As a result of the gear train 120, 121 and the rocker arm 136, 140, 142, a low drive movement of the drive device 41, 43 is necessary to achieve the actuation force of the sliding spool 51, 61 and of the actuator elements 91, 111, 112.

The above-described invention is intended to be illustrative of the present invention and not restrictive thereof. It will be apparent that various changes may be made to the present invention with the spirit and scope of the present invention. The present invention is intended to be defined by the appended claims and equivalents thereto.

What is claimed is:

1. A control valve device for a hydraulic user comprising:

a plurality of hydraulic channels including at least one user channel in communication with the user, a delivery channel and a reservoir channel;

a sliding spool for the control of the connection of at least one user channel with a delivery channel and a reservoir channel;

a shutoff valve located in the user channel which blocks a return flow from the user to the control valve;

a pilot control valve for the actuation of the shutoff valve, wherein when the user channel is connected with the reservoir channel, the pilot control valve can be actuated to move the shutoff valve into the open position;

an actuator element to actuate the pilot valve;

a gear train to actuate the sliding spool and the actuator element, the gear train housing an input element and an output element in a driving connection with the sliding spool and effectively connected with the actuator element; and an electrical drive device effectively connected with the input device.

2. The control valve device as claimed in claim 1 wherein the output element is effectively connected with a cam disc to actuate the actuator element.

3. The control valve device as claimed in claim 2 wherein the cam disc is connected with a rocker arm which is effectively connected with the actuator element.

4. The control valve device as claimed in claim 3 wherein the rocker arm is provided with a rotating roller which is in contact with the cam disc.

5. The control valve device as claimed in claim 3 wherein the actuator element is an actuator pin on an end opposite the pilot control valve in the shape of a sphere and located in a conical-shaped recess of the rocker arm.

6. The control valve device as claimed in claim 2 wherein the cam disc is formed in one piece with the output element.

7. The control valve device as claimed in claim 1 wherein the output element is connected with the sliding spool by a connecting rod.

8. The control valve device as claimed in claim 7 wherein t he connecting rod is suspended in the sliding spool or in the output element.

9. The control valve device as claimed in claim 7 wherein there is a sphere which can be fastened in a spherical recess to connect the connecting rod.

10. The control valve device as claimed in claim 9 wherein the sphere is located on the connecting rod and the spherical recess is located on the output element.

11. The control valve device as claimed in claim 9 wherein the sphere is formed on the connecting rod and the spherical recess is formed on the sliding spool.

12. The control valve device as claimed in claim 7 wherein a boring in which a pin can be rotationally fastened provides the connection of the connecting rod.

13. The control valve device as claimed in claim 12 wherein the boring is located on the output element parallel to the axis of rotation of the output element and the connecting rod is provided with the pin.

14. The control valve device as claimed in claim 13 wherein a fastening fork is on the output element including a recess that is in communication with the boring.

15. The control valve device as claimed in claim 14 wherein in the outer area of a lateral bracket of the fastening fork, there is an opening that extends through the lateral bracket.

16. The control valve device as claimed in claim 1 wherein the gear train includes a spur gear.

17. The control valve device as claimed in claim 16 wherein the output element is a toothed quadrant, which is engaged with an input element that is a gear wheel.

18. The control valve device as claimed in claim 1 wherein the input element is integral with an output shaft of the drive device.

19. The control valve device as claimed in claim 1 wherein the gear train is located in a transmission housing to which the drive device can be fastened and wherein the transmission housing can be fastened to a control valve block of the control valve device.

20. The control valve device as claimed in claim 19 further including a rocker arm that can rotate in the transmission housing.

21. The control valve device as claimed in claim 19 wherein the pilot control valve is located in the transmission housing.

22. The control valve device as claimed in claim 19 further including an actuator pin mounted so that it can move longitudinally in the transmission housing.

23. The control valve device as claimed in claim 19 wherein the transmission housing has an opening in an area that faces the control valve block, and an output shaft of the drive device is rotationally mounted in a housing boring of the transmission housing, wherein the diameter of the input element that is effectively connected with the output shaft is less than or equal to the diameter of the housing boring.

24. The control valve device as claimed in claim 23 wherein in the vicinity of the housing boring, there is a sealing device to seal the output shaft with respect to the transmission housing.

25. The control valve device as claimed in claim 1 wherein the sliding spool is effectively connected with a spring retraction device.

26. The control valve device as claimed in claim 1, wherein the electrical drive device is a stepper motor.

* * * * *

UNITED STATES PATENT AND TRADEMARK OFFICE

CERTIFICATE OF CORRECTION

PATENT NO. : 6,247,494 B1
DATED : June 19, 2001
INVENTOR(S) : Horst Deininger

It is certified that error appears in the above-identified patent and that said Letters Patent is hereby corrected as shown below:

Column 6,
Line 1, "delivery 10 channel 9" should read -- delivery channel 9 --.
Line 6, "connected 15 with" should read -- connected with --.

Column 13, claim 8,
Line 11, "t he" should read -- the --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*